US006306050B1

(12) United States Patent
Holder

(10) Patent No.: US 6,306,050 B1
(45) Date of Patent: Oct. 23, 2001

(54) SWING TRAINING DEVICE

(76) Inventor: Andrew A. Holder, 16214 Tahoe Dr., Houston, TX (US) 77040

( * ) Notice: Subject to any disclaimer, the term of this patent is extended or adjusted under 35 U.S.C. 154(b) by 0 days.

(21) Appl. No.: 09/363,607

(22) Filed: Jul. 29, 1999

(51) Int. Cl.[7] ..... A63B 69/00
(52) U.S. Cl. ..... 473/426; 473/421
(58) Field of Search ..... 473/415–430, 473/476, FOR 102, 103, 104, 108, 109, 116

(56) References Cited

U.S. PATENT DOCUMENTS

| | | | | |
|---|---|---|---|---|
| 3,310,306 | | 3/1967 | Burt . | |
| 4,735,413 | * | 4/1988 | Yamanouchi et al. | 473/429 |
| 4,966,367 | | 10/1990 | Oyarzabal . | |
| 5,072,937 | | 12/1991 | Zarate . | |
| 5,419,550 | | 5/1995 | Blom . | |
| 5,458,326 | * | 10/1995 | Marcyes | 473/426 |
| 5,588,646 | | 12/1996 | Dickson . | |
| 5,776,017 | | 7/1998 | Brawn . | |
| 5,795,250 | * | 8/1998 | Cripe | 473/426 |

* cited by examiner

*Primary Examiner*—Stephen F. Gerrity
*Assistant Examiner*—Mitra Aryanpour
(74) *Attorney, Agent, or Firm*—William P. Jensen; Shook, Hardy & Bacon L.L.P.

(57) ABSTRACT

A swing training device 10 is shown comprising a base 12, a securing member 16 and a suspension system 20 positioned there between. A ball 40 is supported by the suspension system which may be hit repeatedly without obstruction in order to improve a person's swing. The swing training device 10 includes the additional advantages of minimizing undesired horizontal and vertical movement of the ball 40 while stabilizing the ball 40 substantially within a preferred trajectory path.

21 Claims, 3 Drawing Sheets

SWING TRAINING DEVICE

FIELD OF THE INVENTION

This invention relates to a swing training device which enables a person to practice repetitively hitting an object such as a baseball or tennis ball supported by a suspension system that is designed to stabilize the object substantially within a preferred trajectory path during flight of the object.

BACKGROUND OF THE INVENTION

Ball practicing devices of the type herein are useful in improving a person's swing in sports which involve the striking of an object such as a baseball, softball, tennis ball, hand ball or racket ball with a striking instrument such as a racket, bat, or the person's hand. In most sports, eye/hand coordination and muscle memory are needed to improve a person's swing. Muscle memory occurs when a particular motion is repeated a sufficient number of times with accompanying realistic sensations to verify the proper execution of the motion and enable a person to precisely reenact the motion when called upon in a competitive setting. The feel of hitting the ball, the flight of the ball and the landing of the ball each contribute to verify the proper execution of the swing. Thus, a preferred swing pattern is acquired by repetitively hitting a moving ball.

Numerous ball practice devices are described in prior art such as U.S. Pat. No. 3,310,306 (the "'306 patent"); U.S. Pat. No. 4,735,413 (the "'413 patent"); U.S. Pat. No. 4,966,367 (the "'367 patent"); U.S. Pat. No. 5,072,937 (the "'937 patent"); U.S. Pat. No. 5,419,550 (the "'550 patent"); U.S. Pat. No. 5,588,646 (the "'646 patent"); U.S. Pat. No. 5,776,017 (the "'017 patent"); and U.S. Pat. No. 5,795,250 (the "'250 patent"). Most of these ball practice devices are disadvantaged in a number of respects. For example, many devices such as the '306, '413, '937, '017, '250 and '550 patents are constructed of an elastic suspension system that supports the ball and restricts either horizontal or vertical movement of the ball once it is hit, but not both. Accordingly, uneven support of the ball typically results in an unnatural ball trajectory path that is subject to undesirable effects such as tethering and/or vibrating. Another inherent disadvantage is the possibility that the ball may hit the user as a result of an unnatural and random ball trajectory path.

Developments in the art of ball practice devices have addressed some of the foregoing disadvantages however, fail to achieve the results of the present invention. For example, the '367 patent discloses a ball striking apparatus that employs an adjustable intermediate (safety) cord on the vertical portion of the apparatus in order to anchor the ball and prevent it from striking the user. Both the ball and the safety cord are vertically adjustable. However, the safety cord causes the ball to pull toward the frame member 10*b* and away from its intended path of travel. The '646 patent describes a tethered ball batting practice device that presents a number of obstructions and distractions. In order to avoid striking the flexible cords 32, the ball must be precisely hit toward the ground. Additionally, the T-shaped frame members are a physical obstruction. If the ball is hit hard enough, it will either strike the frame members or wrap around them. The frame members are also a distraction.

The problems encountered in the art of ball practice devices reveal the need for a swing training device that substantially eliminates obstructions, minimizes undesired horizontal and vertical movement of the ball and stabilizes the ball substantially within a preferred trajectory path.

SUMMARY OF THE INVENTION

It is therefore, a principle object of the present invention to provide a swing training device that substantially eliminates undesired horizontal and vertical movement of the ball after the ball is hit.

It is another object of the present invention to provide a swing training device that stabilizes the ball substantially within a preferred trajectory path once the ball is hit.

It is another object of the present invention to provide a swing training device that may be repetitively used without the undesired effects of tethering and/or vibrating.

It is an advantage of the present invention to provide a swing training device with a safety cord that prevents the ball from striking the user after the ball is hit.

It is another advantage of the present invention to provide a swing training device that may be easily disassembled and transported for use in a variety of environments.

It is another advantage of the present invention to provide a swing training device that is easy to construct and use.

It is yet another advantage of the present invention to provide a swing training device that may be used in a relatively confined environment indoors.

It is yet another advantage of the present invention to provide a swing training device that includes a ball supported by an integral suspension system.

It is yet another advantage of the present invention to provide a swing training device that includes a ball which is adjustably supported by a suspension system in order that the ball may be vertically adjusted for different uses and users.

It is a feature of the present invention to provide a swing training device that includes a ball supported by a suspension system between a base and a securing member.

It is another feature of the present invention to provide a swing training device that includes a ball supported by a suspension system over a pentagon shaped base plate.

It is yet another feature of the present invention to provide a swing training device that includes a ball supported by a suspension system between a ground surface and a securing member.

It is yet another feature of the present invention to provide a swing training device that includes a ball supported by a suspension system which is secured between a base and a securing member by a plurality of pulleys.

The foregoing objects and advantages are achieved through the swing training device of the present invention which comprises a base having a base surface and a securing member positioned above the base. A suspension system is positioned between the base and the securing member, and includes a plurality of elastic segment lengths. The plurality of elastic segments lengths include at least a first and second segment length each having an end secured to one of the first securing member and the base. The first and second segment lengths extend from the end toward a reference point defined by an intersection of an imaginary projection of a first axis of the first segment length and a second axis of the second segment length. The plurality of elastic segment lengths further include a third segment length having an end secured to another of the first securing member and the base. The first second and third segment lengths each substantially lie within a plane that is perpendicular to the base surface at a static position. A ball is supported by the suspension system between the base and the first securing member. The reference point is spaced substantially equidistantly from the end of the first and second segment lengths. A distance between a surface of the ball and the reference point is less than a distance between the reference point and the base surface.

In a preferred embodiment, the plurality of elastic segment lengths include a fourth segment length which controls the trajectory of the ball and prevents the ball from striking the user. The fourth segment length has an end secured to the base and another end connected to at least one of the first, second and third segment lengths. Alternatively, the another end of the fourth segment length may be operatively interconnected with the first, second and third segment lengths. The base is releasably connected to the securing member and includes a plurality of supporting frame members and a pentagon shaped base plate secured to at least one of the plurality of frame members. At least one of the frame members is connected to the securing member. Alternatively, the base may be separated from the securing member and include a stationary ground surface. The end of each first and second segment length is secured to the one of the securing member and the base by a respective first and second pulley. Likewise, the end of the third segment length is secured to another of the securing member and the base by a third pulley. The first and second segment lengths are secured to the base and the third segment length is secured to the securing member. Alternatively, the first and second segment lengths are secured to the securing member and the third segment length is secured to the base. The first, second and third segment lengths are integral, however, may be operatively interconnected. The ball is adjustably positioned on the third segment length for vertical adjustment to accommodate different uses and users. The reference point is positioned within the ball, however, may be positioned between the ball and the base surface provided that a distance between the surface of the ball and the reference point is less than a distance between the reference point and the base surface.

In another embodiment, the swing training device includes a base having a base surface and a securing member position above the base. A suspension system is positioned between the base and the securing member. The suspension system includes a plurality of elastic segment lengths. The plurality of elastic segment lengths include at least a first and second segment length each having an end secured to one of the first securing member and the base. The first and second segment lengths extend from the end toward a ball supported by the suspension system between the base and the first securing member. The plurality of elastic segment lengths further include a third and fourth segment length. The third length includes an end secured to another of the first securing member and the base. The first, second and third segment lengths each substantially lie within a plane that is perpendicular to the base surface at a static position. The fourth segment length includes an end secured to the base and another end connected to at least one of the first, second and third segment lengths. Alternatively, the fourth segment length may be operatively interconnected with the first, second and third segment lengths. The base is releasably connected to the securing member and includes a plurality of supporting frame members and a pentagon shaped base plate secured to at least one of the plurality of frame members. At least one of the frame members is connected to the securing member. The first, second and third segment lengths are integral, however, may be operatively interconnected. The ball is adjustably positioned on the third segment length for vertical adjustment to accommodate a variety of different uses and users.

The above and other objects, advantages and features of the present invention will become apparent from the following detailed description wherein reference is made to the figures and accompanying drawings.

USER (NOT SHOWN) DESCRIPTION OF THE PREFERRED EMBODIMENTS

Figure 2:
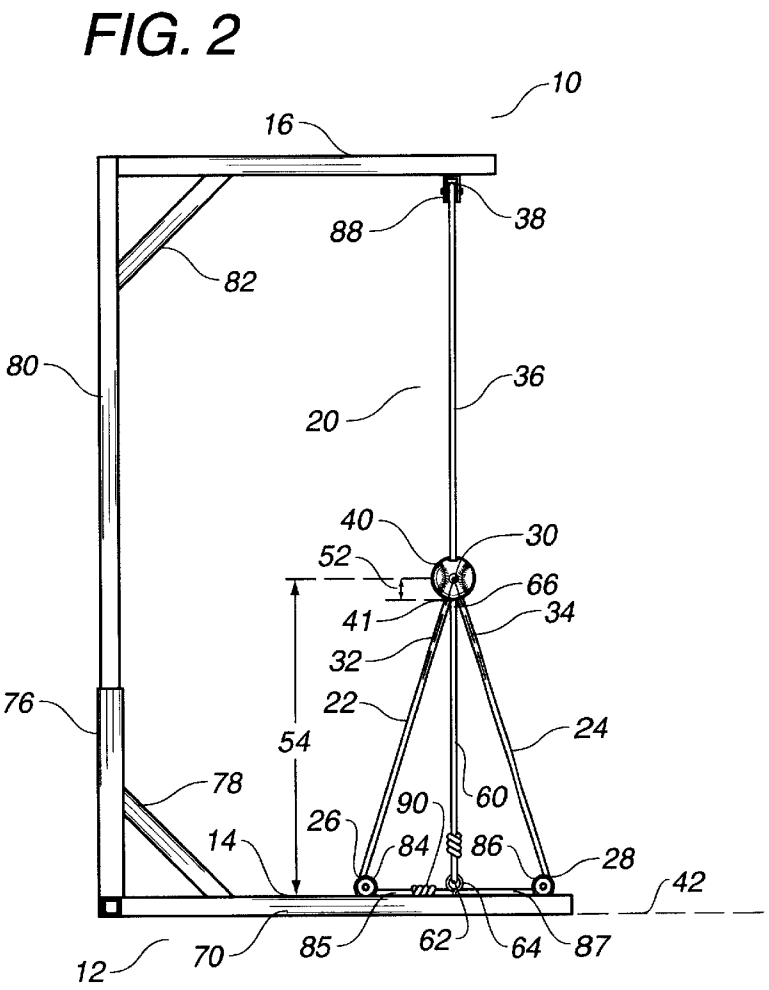
FIG. 2 is a side elevational view of the embodiment depicted in FIG. 1.
Figure 1:
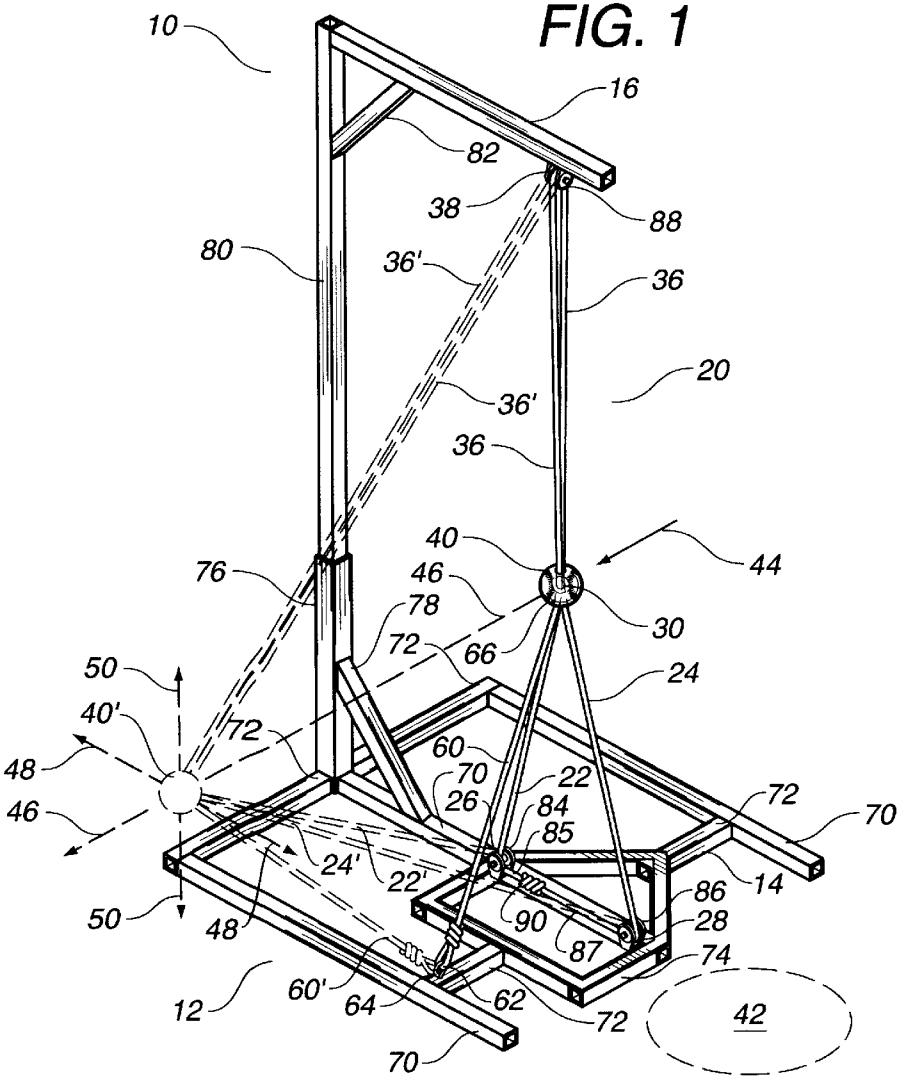
FIG. 1 is a perspective view of one embodiment of the swing training device according to the present invention depicting movement of the ball substantially within a preferred trajectory path.
Figure 3:
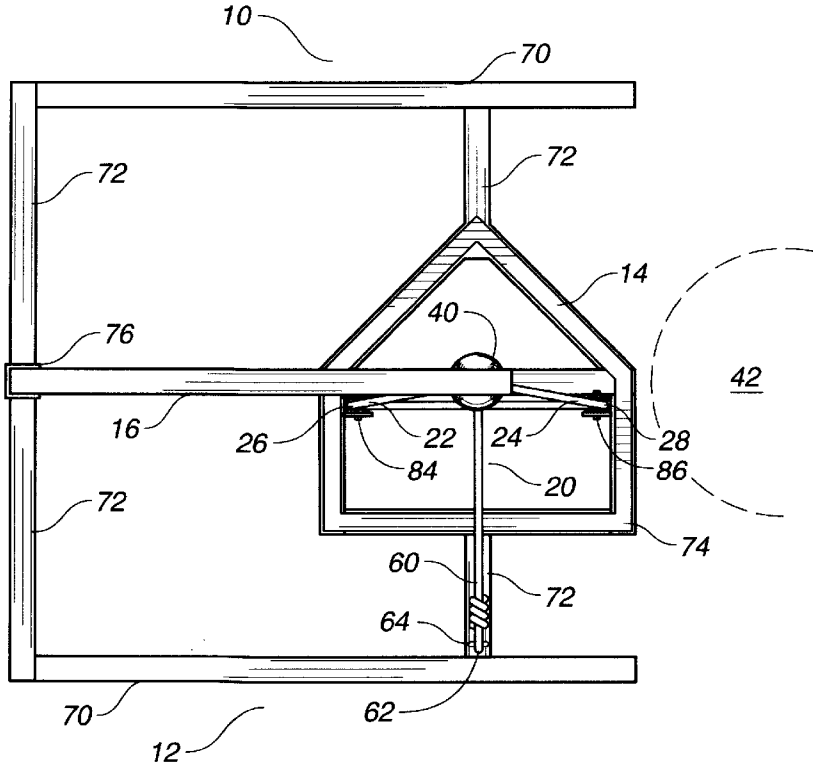
FIG. 3 is a top view of the embodiment depicted in FIG. 1.

Referring to FIGS. 1–3, one embodiment of the swing training device 10 is shown in perspective view comprising a base 12, a securing member 16 and a suspension system 20. The base 12 includes a base surface 14. The securing member 16 is positioned above the base 12. The suspension system 20 is positioned between the base 12 and the securing member 16, and includes a plurality of elastic segment lengths. The plurality of elastic segment lengths are made of any elastomeric material such as rubber bound by a woven fiber and include a first 22 and second 24 segment length. The first and second segment lengths 22 and 24 each have a respective end 26 and 28 secured to the base 12. As shown in FIG. 2, the first and second segment lengths 22 and 24 extend from their respective end 26 and 28 toward a reference point 30 defined by an intersection of an imaginary projection of a first axis 32 of the first segment length 22 and a second axis 34 of the second segment length 24.

The plurality of elastic segment lengths include a third segment length 36 having an end 38 secured to the first securing member 16. The first, second and third segment lengths 22, 24 and 36 each substantially lie within a plane that is perpendicular to the base surface 14 at a static position.

A ball 40 is supported by the suspension system 20 between the base 12 and the first securing member 16. The reference point 30 is spaced substantially equidistantly from the respective end of the first and second segment length 26 and 28. A distance 52 between a surface of the ball 41 and the reference point 30 is less than a distance 54 between the reference point 30 and the base surface 14. The position of the reference point 30 from the end of the first and second segment lengths 26 and 28, and its position between the surface of the ball 41 and the base surface 14 ensures that the ball 40 will travel substantially within a preferred trajectory path 46 once the ball is hit. A user (not shown) of the swing training device 10 may stand at a normal position 42 and hit the ball without obstruction from the swing training device 10. In most applications, it is typically preferred to repeat a swing along a path that is substantially parallel to the ground producing a "line drive" hit. Accordingly, in applications such as tennis or baseball, the user may repetitively hit the ball 40 from a direction indicated by arrow 44 resulting in movement of the ball 40 substantially within the preferred trajectory path 46 that is substantially parallel to the base surface 14.

Once the ball 40 is hit from direction 44, it travels substantially within the preferred trajectory path 46 to an extended position shown in phantom by the ball 40'. The first, second and third segment lengths 22, 24 and 36, stretch and extend as shown in phantom by the first, second and third segment lengths 22', 24' and 36'. The position of the reference point 30 from the end of the first and second segment lengths 26 and 28, and its position between the surface of the ball 41 and the base surface 14 also ensures that displacement of the ball 40 from the preferred trajectory path 46 is minimized along a horizontal axis 48 and vertical axis 50. In other words, the suspension system 20 is designed to stabilize the ball 40 substantially within the preferred trajectory path 46. Displacement along the vertical axis 50 is reduced by positioning the ball 40 between the first and second segment lengths 22 and 24, and the third segment length 36. More importantly, displacement along the horizontal axis 48 is reduced by securing the first and second segment lengths 22 and 24 to the base 12, and positioning the reference point 30 equidistantly from the end of the first and second segment lengths 26 and 28. Displacement along the horizontal axis 48 is also reduced by maintaining a distance 52 between the surface of the ball 41 and the reference point 30 that is less than a distance 54 between the reference point 30 and the base surface 14 shown in FIG. 2. Thus, the closer the reference point 30 is positioned to the ball 40, the less likely displacement will occur along the horizontal axis 48 and vice-versa. As a result, the swing training device 10 permits the user to repeatedly hit the ball 40 without obstruction and without substantial displacement from the preferred trajectory path 46.

In order to prevent the ball 40 from striking the user, the plurality of elastic segment lengths include a fourth segment length 60 which acts as a safety cord and substantially reduces movement of the ball 40 in a direction opposite the direction 44 of the swing. The fourth segment length 60 is positioned anywhere opposite the ball 40 relative to the direction 44 of the swing. The fourth segment length 60 has an end 62 secured to the base 12 by a fastener 64. The fastener 64 is connected to the base surface 14. As shown in FIGS. 1 and 2, another end 66 of the fourth segment length 60 is connected to the first and second segment lengths 22 and 24. Ideally, the fourth segment length 60 is positioned such that the end 62 is equidistantly spaced from the end of the first and second segment lengths 26 and 28, and another end 66 is connected to the first and second segment lengths 22 and 24 at the reference point 30. Alternatively, another end 66 of the fourth segment length 60 may be connected to the third segment length 36 between the reference point 30 and the ball 40. Thus, the position of the fourth segment length 60 does not interfere with the flight of the ball 40 along the preferred trajectory path 46. Further, tension may be independently adjusted in the fourth segment length 60 in order that the fourth segment length 60 may extend as shown in phantom by the fourth segment length 60' as the ball 40 travels along the preferred trajectory path 46.

The base 12 and securing member 16 are releasably connected and are preferably made of square metal tubing, however, may be made of any other durable weighted material sufficient to withstand the forces encountered during use of the swing training device 10. The base 12 includes a plurality of supporting frame members. More particularly, the base 12 includes a plurality of longitudinal supporting frame members 70 interconnected by a plurality of transverse supporting frame members 72 and a pentagon shaped base plate 74 for added stability. The base plate 74 may also be used as a reference point for applications such as baseball. Thus, one or more of the transverse supporting frame members 72 and the base plate 74 may be removed depending on whether the swing training device 10 is used for baseball, tennis or some other swing training application. A vertical supporting frame member 76 is positioned perpendicular to the base 12 and between two transverse supporting frame members 72. The vertical supporting frame member 76 is secured to the base 12 by a diagonal supporting frame member 78. The diagonal supporting frame member 78 is connected at one end to one of the longitudinal supporting frame members 70 and at another end to the vertical supporting frame member 76. Alternatively, the diagonal supporting frame member 78 may be connected at one end to one of the transverse supporting frame members 72 and at another and to the vertical supporting frame member 76.

The vertical supporting frame member 76 is constructed of slightly larger square metal tubing than the securing member 16 in order that an elbow extension 80 of the securing member 16 may be received within the vertical supporting frame member 76. Alternatively, the elbow extension 80 may be integrally joined with the vertical supporting frame member 76. The securing member 16 and the elbow extension 80 are connected perpendicular to one another and are supported by a diagonal securing member 82. The components that make up base 12 and securing member 16 are welded together, however, may be joined in any other durable manner depending on the materials used. Accordingly, the swing training device 10 may be broken down into at least three primary components comprising the base 12, the securing member 16 and the suspension system 20 for simple assembly and transportation.

Still referring to FIGS. 1–3, the end of each first and second segment length 26 and 28 is secured to the base 12 by a respective first and second pulley 84 and 86. Likewise, the end of the third segment length 38 is secured to the securing member 16 by a third pulley 88. The first, second and third segment lengths 22, 24 and 36 are preferably integral as shown in FIGS. 1–3. Thus, a single elastic member may be used for the suspension system 20. Alternatively, the first, second and third segment lengths 22, 24 and 36 may be operatively interconnected as shown in reference to FIG. 6. An advantage of using an integral suspension system 20 is the ability to simultaneously adjust the tension in the first, second and third segment lengths 22, 24 and 36 at 90. As the tension in the suspension system 20 is increased, the preferred trajectory path 46 becomes shorter and the time it takes for the ball 40 to travel along the preferred trajectory path 46 is reduced. Thus, the tension in the suspension system 20 may be uniformly adjusted to alter the distance the ball 40 travels and its corresponding speed.

The elastic member is positioned through the third pulley 88 and the ball 40 thus, forming another half of the third segment length 36. Once the third segment length 36 passes through the ball 40, the first and second segment lengths 22 and 24 are formed by positioning the elastic member through the first and second pulley 84 and 86, and tying a first and second end 85 and 87 of the elastic member together at 90. An advantage of using first, second, and third pulleys 84, 86 and 88 is the ability to reduce friction and wear on the integral suspension system 20 as it is stretched and moves over the first, second and third pulleys 84, 86 and 88.

The ball 40 is adjustably positioned on the third segment length 36 to accommodate different uses and users. The ball 40 is slidably adjusted on the third segment length 36 by removing the end of the fourth segment length 66 from the suspension system 20 and simply moving the ball 40 vertically up or down. A practice ball such as a baseball or tennis ball may be used by boring a friction fit hole there through that is large enough for receipt of the first, second and third segment lengths 22, 24 and 36, yet small enough to prevent movement of the ball 40 along the suspension system 20 once the ball 40 is hit. As the ball 40 is vertically adjusted, the first, second and third segment lengths 22, 24 and 36 will proportionately change in length and the reference point 30 will remain within the ball 40. For example, as the ball 40 is moved closer toward the end of third segment length 38, the third segment length 36 becomes shorter, the first and second segment lengths 22 and 24 become longer and the reference point 30 remains within the ball 40. Conversely, as the ball 40 is moved closer toward the base surface 14, the first and second segment lengths 22 and 24 become short, the third segment length 36 becomes longer and the reference point 30 remains within the ball 40. Once the ball 40 is positioned at an appropriate height for the user, the fourth segment length 60 may be reattached to the suspension system 20. Thus, another advantage of using an integral suspension system 20 is the ability to consistently maintain an optimal ratio between the shorter distance 52 and the longer distance 54 which minimizes displacement of the ball 40 from the preferred trajectory path 46 along the horizontal axis 48.

The suspension system 20 may also be constructed to provide the user with a variety of different positions for hitting the ball 40 to simulate different swing patterns. For example, the first and second pulleys 84 and 86 may be connected to the base surface 14 farther from the user standing at a normal position 42. Likewise, the third pulley 88 may be connected to the securing member 16 farther from the user standing at a normal position 42. Accordingly the ball 40 would be placed farther from the user standing at a normal position 42 to simulate, in baseball, an outside pitch. Conversely, the suspension system 20 may be moved closer toward the user standing at the normal position 42 to simulate an inside pitch.

Figure 4:
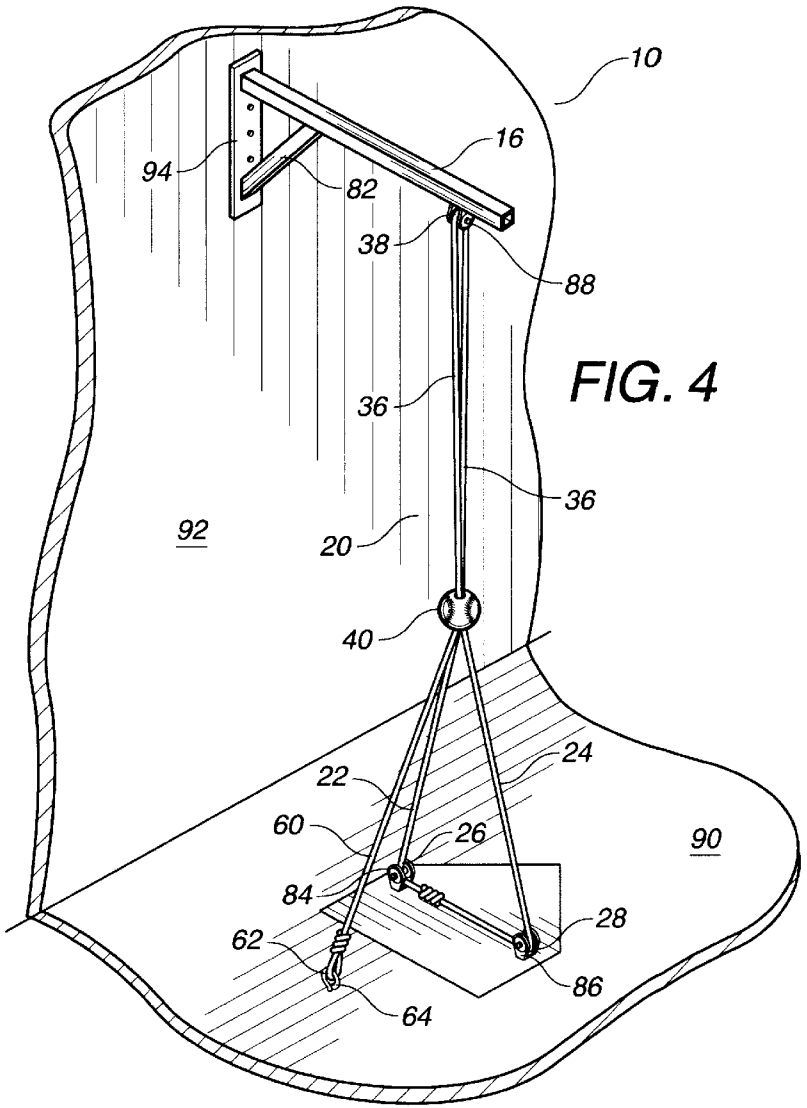
FIG. 4 is a perspective view of a second embodiment of the present invention.

Referring now to FIG. 4, a perspective view of a second embodiment of the swing training device 10 is shown without the base 12 shown in FIGS. 1–3. Instead, the end of each first and second segment length 26 and 28 is secured to a stationary ground surface 90 by the respective first and second pulley 84 and 86. The end of the third segment length is secured to the securing member 16 by the third pulley 88. The securing member 16 includes a securing plate 94 attached to a stationary wall surface 92. The end of the fourth segment length 62 is secured to the ground surface 90 by the fastener 64. Accordingly, the primary component parts needed to construct the swing training device 10 are limited to the suspension system 20 and the securing member 16 thus, reducing the cost associated with constructing the swing training device 10 shown in FIG. 4.

Figure 5:
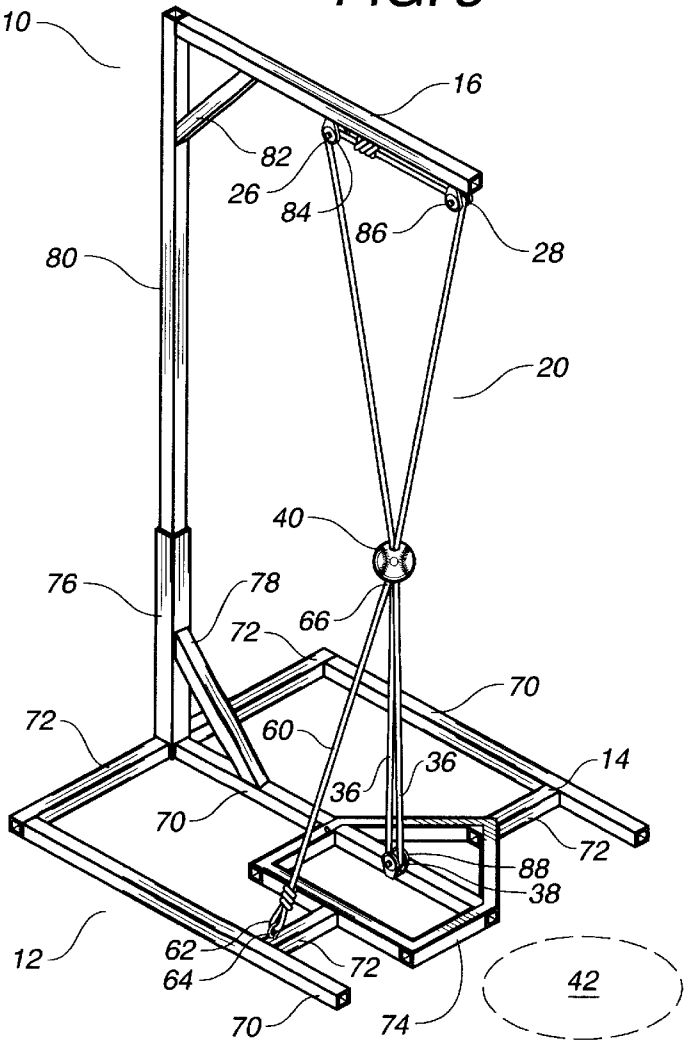
FIG. 5 is a perspective view of a third embodiment of the present invention.

Referring now to FIG. 5, a perspective view of a third embodiment of the swing training device 10 is shown. The swing training device 10 includes a suspension system 20 like that described in reference to FIGS. 1–3, except that the suspension system 20 has been inverted without compromising any functional advantages. Accordingly, the end of the first and second segment length 26 and 28 is secured to the securing member 16 and the end of the third segment length 38 is secured to the base 12. The another end 66 of the fourth segment length 60 is connected to the third segment length 36.

Figure 6:
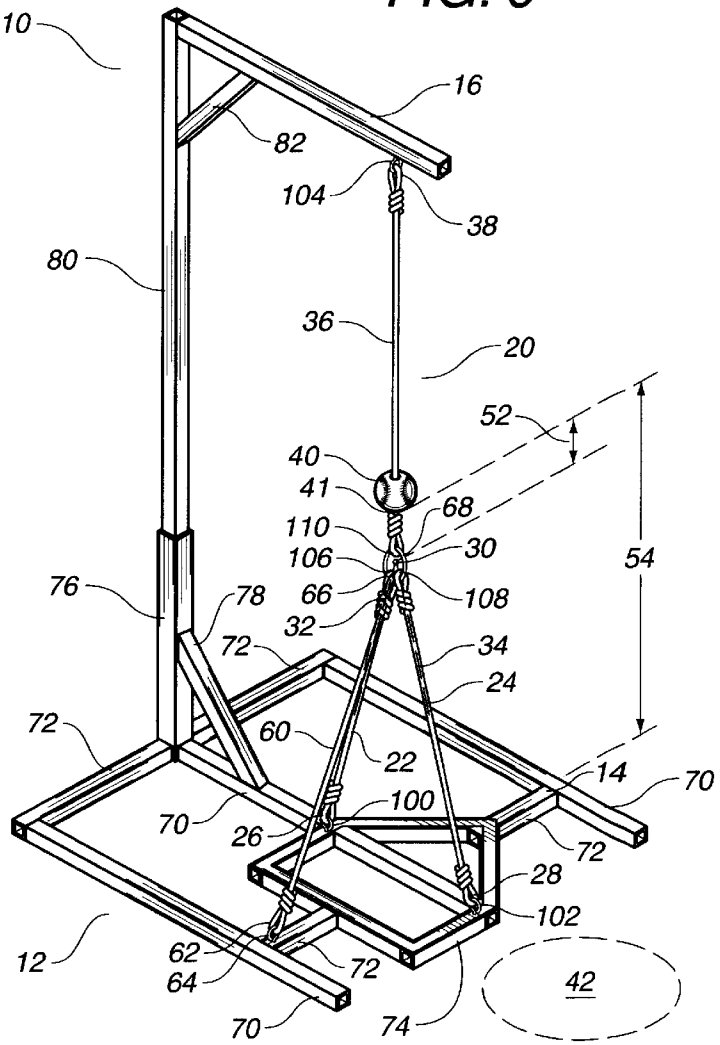
FIG. 6 is a perspective view of a fourth embodiment of the present invention.

Referring now to FIG. 6, a perspective view of a fourth embodiment of the swing training device 10 is shown. The suspension system 20 is functionally similar to that described in reference to the suspension system 20 shown in FIGS. 1–3, except that the first, second and third segment lengths 22, 24 and 36 are operatively interconnected by a metal ring 68 instead of being integral. Accordingly, the end of each first and second segment length 26 and 28 is secured to the base 12 by a respective first and second fastener 100 and 102. Likewise, the end of the third segment length is secured to the securing member 16 by a third fastener 104. The first and second segment lengths 22 and 24 include a respective another end 106 and 108. The another end of the first and second segment lengths 106 and 108 is connected to the metal ring 68. Likewise, the third segment length 36 includes another end 110 connected to the metal ring 68. The another end of the fourth segment length 66 is also connected to the metal ring 68. Accordingly, the another end of the first, second, third and fourth segment lengths 106, 108, 110 and 66 is connected to the metal ring 68 to form the suspension system 20 shown in FIG. 6. The suspension system 20 is virtually identical to the suspension system 20 shown in FIGS. 1–3, except that the reference point 30 is static and positioned between the ball 40 and the base surface 14. The advantages of the swing training device 10 shown in FIG. 6 are similar to those described in reference to FIGS. 1–3, provided that the distance 52 between the surface of the ball 41 and the reference point 30 is less than the distance 54 between the reference point 30 and the base surface 14. In particular, the user may independently adjust the tension in each first, second, third and fourth segment length 22, 24, 36 and 60. If the tension in the first and second segment lengths 22 and 24 is uneven, then the user may alter the preferred trajectory path 46 to simulate an inside or outside pitch relative to the user standing at a normal position 42 in baseball.

Although there have been described what are considered to be the preferred embodiments of the present invention, it will be understood that the invention may be embodied in other specific forms without departing from the spirit or essential characteristics thereof. The present embodiments are therefore, to be considered in all respects illustrative. The scope of the invention is indicated by the appended claims rather than by the forgoing description.

What is claimed is:

1. A swing training device comprising:

a base having a base surface;

a securing member positioned above the base, said securing member substantially lying within a plane parallel to the base surface;

a suspension system positioned between the base and the securing member, the suspension system including a plurality of elastic segment lengths, at least a first and second segment lengths each having an end secured to one of the securing member and the base, the first and second segment lengths extending from the respective ends toward a reference point defined by an intersection of an imaginary projection of a first axis of the first segment length and a second axis of the second segment length, a third segment length having an end secured to another of the first securing member and the base, the first, second and third segment lengths each substantially lying within a plane that is perpendicular to the base surface at a static position;

a ball supported by the suspension system between the base and the securing member; and the reference point being spaced substantially equidistantly from each end of the first and second segment lengths, a distance between a surface of the ball and the reference point being less than a distance between the reference point and the base surface.

2. The swing training device of claim 1, further comprising a fourth segment length having an end secured to the base and another end connected to at least one of the first, second and third segment lengths.

3. The swing training device of claim 1, further comprising a fourth segment length having an end secured to the base and another end operatively interconnected with the first, second and third segment lengths.

4. The swing training device of claim 1, wherein the base is releasably connected to the securing member.

5. The swing training device of claim 4, wherein the base includes a plurality of supporting frame members and a pentagon shaped base plate secured to at least one of the plurality of frame members, at least one of the frame members connected to the securing member.

6. The swing training device of claim 1, wherein the base includes a stationary ground supported surface.

7. The swing training device of claim 1, wherein the end of each first and second segment length is secured to the one of the securing member and the base by a respective first and second pulley.

8. The swing training device of claim 7, wherein the end of the third segment length is secured to another of the securing member and the base by a respective third pulley.

9. The swing training device of claim 1, wherein the first and second segment lengths are secured to the base and the third segment length is secured to the securing member.

10. The swing training device of claim 1, wherein the first and second segment lengths are secured to the securing member and the third segment length is secured to the base.

11. The swing training device of claim 1, wherein the first, second and third segment lengths are integral.

12. The swing training device of claim 1, wherein the first, second and third segment lengths are operatively interconnected.

13. The swing training device of claim 1, wherein the ball is adjustably positioned on the third segment length.

14. The swing training device of claim 1, wherein the reference point is positioned within the ball.

15. The swing training device of claim 1, wherein the reference point is positioned between the ball and the base surface.

16. A swing training device comprising:

a base having a base surface;

a securing member positioned above the base;

a suspension system positioned between the base and the securing member, the suspension system including a plurality of elastic segment lengths, at least a first and second segment lengths each having an end secured to one of the securing member and the base, the first and second segment lengths extending from the respective ends toward a reference point defined by an intersection of an imaginary projection of a first axis of the first segment length and a second axis of the second segment length, a third segment length having an end secured to another of the first securing member and the base, the first, second and third segment lengths each substantially lying within a plane that is perpendicular to the base surface at a static position;

a ball supported by the suspension system between the base and the securing member, the ball being slidably positioned on the third segment length; and the reference point being maintained at a substantially constant distance from the ball as the ball is adjusted on the third segment length a distance between a surface of the ball and the reference point being less than a distance between the reference point and the base surface.

17. The swing training device of claim 16, further comprising a fourth segment length having an end secured to the base and another end connected to at least one of the first, second and third segment lengths.

18. The swing training device of claim 16, wherein the base is releasably connected to the securing member.

19. The swing training device of claim 18, wherein the base includes a plurality of supporting frame members and a pentagon shaped base plate secured to at least one of the plurality of frame members, at least one of the frame members connected to the securing member.

20. The swing training device of claim 16, wherein the first, second and third segment lengths are integral.

21. The swing training device of claim 16, wherein the ball is adjustably positioned on the third segment length.

* * * * *